US005815961A

United States Patent [19]

Estes et al.

[11] Patent Number: 5,815,961

[45] Date of Patent: Oct. 6, 1998

[54] CLOTHES TREATING CABINET WITH INFLATABLE HANGER

[75] Inventors: Kurt A. Estes, South Bend, Ind.; Phalguni S. Roy, St. Joseph, Mich.; David Hung-Chih Chen, St. Joseph, Mich.; Kevin S. Maki, St. Joseph, Mich.

[73] Assignee: Whirlpool Corporation, Benton Harbor, Mich.

[21] Appl. No.: 870,668

[22] Filed: Jun. 6, 1997

Related U.S. Application Data

[60] Provisional application No. 60/020,599 Jun. 26, 1996.

[51] Int. Cl.[6] ..... D06F 71/16

[52] U.S. Cl. ..... 38/14; 38/1 A; 223/67

[58] Field of Search ..... 38/1 A, 1 R, 1 D, 38/6, 7, 2, 3, 12, 14; 312/109; 219/254, 521, 385; 34/77, 219, 440; 223/52, 66, 67, 68, 70, 77, 85, 92, 57

[56] References Cited

U.S. PATENT DOCUMENTS

| | | | |
|---|---|---|---|
| D. 332,329 | 1/1993 | Hood et al. | D32/8 |
| 522,991 | 7/1894 | Laubin . | |
| 2,606,272 | 8/1952 | Platt | 219/38 |
| 2,834,523 | 5/1958 | Maxwell et al. | 223/57 |
| 2,911,729 | 11/1959 | Wood | 34/37 |
| 3,070,268 | 12/1962 | Carpenter | 223/57 |
| 3,432,939 | 3/1969 | Eichholz | 34/151 |
| 3,475,828 | 11/1969 | Feldman et al. | 34/32 |
| 3,480,187 | 11/1969 | Bonn | 223/67 |
| 3,482,745 | 12/1969 | Forman | 223/67 |
| 3,576,079 | 4/1971 | Hauser | 34/46 |
| 3,670,425 | 6/1972 | Benjamin et al. | 34/4 |
| 3,739,496 | 6/1973 | Buckely et al. | 34/210 |
| 3,793,744 | 2/1974 | Saita | 34/104 |
| 3,805,561 | 4/1974 | Bullock | 68/5 C |
| 3,947,971 | 4/1976 | Bauer | 34/60 |
| 4,180,919 | 1/1980 | Baltes | 34/23 |
| 4,493,160 | 1/1985 | Brembilla et al. | 38/14 |
| 4,682,424 | 7/1987 | Irving | 34/151 |
| 4,694,146 | 9/1987 | DeMars | 219/524 |
| 5,075,989 | 12/1991 | Cartabbia | 38/6 |
| 5,094,020 | 3/1992 | Wingfield et al. | 38/1 A |
| 5,148,995 | 9/1992 | Cares | 223/70 |
| 5,152,077 | 10/1992 | Liang | 34/77 |
| 5,305,484 | 4/1994 | Fitzpatrick et al. | 8/149.3 |
| 5,361,516 | 11/1994 | Dahman | 34/440 |
| 5,474,216 | 12/1995 | Harrod et al. | 223/68 X |
| 5,692,326 | 12/1997 | Mohan et al. | 38/7 |

*Primary Examiner*—Ismael Izaguirre
*Attorney, Agent, or Firm*—Stephen D. Krefman; Thomas J. Roth; Joel M. Van Winkle

[57] ABSTRACT

A clothes treating apparatus and method for subjecting clothes items to moisture, pressure and heat for refreshing and dewrinkling the clothes items. A cabinet defines an interior region for receiving clothes, the interior region having opposed inner side surfaces. A door is hingedly connected to the cabinet for closing the interior region. An inflatable hanger for supporting shirt-like clothes items is disposed within the interior region. A blower selectively inflates the inflatable hanger for pressing the shirt-like clothes item against the cabinet inner side surfaces. A steam generation means is provided for introducing moist air into the cabinet for humidifying the clothes item disposed therein. A heater and fan supply heated air into the interior region for drying the shirt-like clothes items disposed therein. During the dewrinkling cycle, steam is introduced into the interior region while the inflatable hanger assembly is periodically inflated. Following the steaming period, the inflatable hanger is inflated while the clothes are subject to warm air such that the clothes wrinkles are pressed out and the clothes are partially dried, setting the clothes in a smooth appearance. Heated air is then delivered into the interior region to completely dry the clothes item.

27 Claims, 5 Drawing Sheets

CLOTHES TREATING CABINET WITH INFLATABLE HANGER

This application claims the benefit of U.S. Provisional Application No. Ser. 60/020,599 filed Jun. 26, 1996.

BACKGROUND OF THE INVENTION

The present invention relates to a clothes treating apparatus and more particularly to an apparatus for deodorizing and dewrinkling clothes items through the application of moisture, heat, pressure, and tension.

Clothes steaming and drying cabinets for treating clothes items are known. For example, U.S. Pat. No. 3,752,373 discloses a cabinet comprising a housing of flexible material which defines an interior region for hanging clothes. A steam generator is mounted in the lower region of the housing to steam the clothes. A fan and heating element are also provided in the lower portion of the housing for delivering heated air into the interior region for drying and airing the clothes.

A significant shortcoming of this type of clothes cabinet is that it does not dewrinkle clothes very well. It is known that successful dewrinkling of clothes items is best achieved by applying a combination of heat, moisture, pressure, and tension to the clothes. U.S. Pat. No. 3,752,373 and equivalent prior art designs provide no means for applying pressure to clothes items.

An example of an attempt to overcome this shortcoming in the prior art is found in U.S. Pat. No. 5,305,484. This patent discloses a cabinet for receiving clothes having a steam delivery means and a hot air delivery means. The appliance includes a steaming cycle and a drying cycle. Hangers and a bar are provided for suspending clothes items and weighted bars are provided to tension the clothes such that wrinkles are removed. In this system tension is in effect substituted for pressure such that clothes will be adequately dewrinkled. This type of system has not been found effective in dewrinkling clothes to a level approaching conventional clothes dewrinkling techniques.

There are inherent short comings in using tension as the primary mechanism to dewrinkle fabric and the system disclosed in U.S. Pat. No. 5,305,484 has been found to be relatively ineffective in dewrinkling. Applying weights to clothes as described above results in a non-uniform tensioning of the clothes wherein the clothes are pulled straight in only one direction. This can result in setting wrinkles into the clothes and stretching the clothes out of shape. In contrast, applying pressure to clothes, as in a conventional ironing process, smoothes the clothes out and applies pressure equally in all directions.

U.S. Pat. No. 3,480,187 discloses a pressing machine which utilizes an inflatable air bag for dewrinkling clothes items. The inflatable bag is dressed with a shirt-like garment and inflated such that the garment is tightly stretched. Hot air can be used to dry the garment while it is tightly stretched such that the garment is dewrinkled. This type of system includes several short comings. First, this type of system does not dewrinkle clothes very well. Further, this type of system requires a plurality of clamps to ensure that the garment is held in place when the garment is stretched.

U.S. Pat. No. 4,493,160 discloses a clothes treatment cabinet. This disclosure appears to illustrate a system wherein shirt-like articles are fitted to mannequin-like supports and subjected to steam. However, this reference provides no teaching for applying tension to a shirt-like clothes item to accomplish dewrinkling.

It can be readily seen that it would be a substantial improvement in the art to provide a clothes treatment cabinet which included means for effectively dewrinkling clothes by applying pressure to the clothes. Moreover it would be an improvement in the prior art to provide a clothes treatment cabinet which is easy to use and required relatively little effort to correctly position clothes items for dewrinkling and freshening.

SUMMARY OF THE INVENTION

A clothes treating apparatus for subjecting clothes items to moisture, pressure, tension and heat for refreshing and dewrinkling the clothes items. The apparatus includes a cabinet which encloses an interior region, having opposed inner side surfaces, for receiving clothes. A door is hingedly connected to the cabinet for closing the interior region. An inflatable hanger for supporting shirt-like clothes items is disposed within the interior region. A blower can selectively inflate the inflatable hanger for pressing the shirt-like clothes item against the cabinet inner side surfaces. A lower housing supports a steam generation means for introducing moist air into the cabinet for humidifying the clothes item disposed therein. A heater and fan, also disposed in the lower housing, supply heated air into the interior region for drying the shirt-like clothes items disposed therein.

During the dewrinkling cycle, steam is introduced into the interior region while the inflatable hanger assembly is periodically inflated. Following the steaming period, the inflatable hanger is inflated while the clothes are subject to heated air such that the clothes wrinkles are pressed out and the clothes are partially dried, setting the clothes in a smooth appearance. Subsequently, heated air is delivered into the interior region for completely drying the clothes item.

The preferred embodiment of the present invention provides for dewrinkling a plurality of clothes items in one cycle. In this second embodiment, a divider wall is hingedly supported within the cabinet for separating the interior region into two compartments, each compartment having opposed side surfaces. An inflatable hanger can be associated with one of the compartments such that when the inflatable hanger assembly is inflated the clothes item is pressed against the opposed side surfaces of the compartment in which the hanger is positioned. Alternatively, two inflatable hanger assemblies can be provided, one hanger being associated with each compartment. The door of the cabinet can include an inner recess and an inner door can be hingedly connected to the cabinet for separating the door recess compartment from the interior region of the cabinet. Still further, the clothes treating apparatus of the present invention can include a support bar disposed in the door recess or in one of the interior region compartments such that pants-like items can be supported and treated with humidity and hot air.

DETAILED DESCRIPTION OF THE PREFERRED EMBODIMENTS OF THE INVENTION

Figure 1:
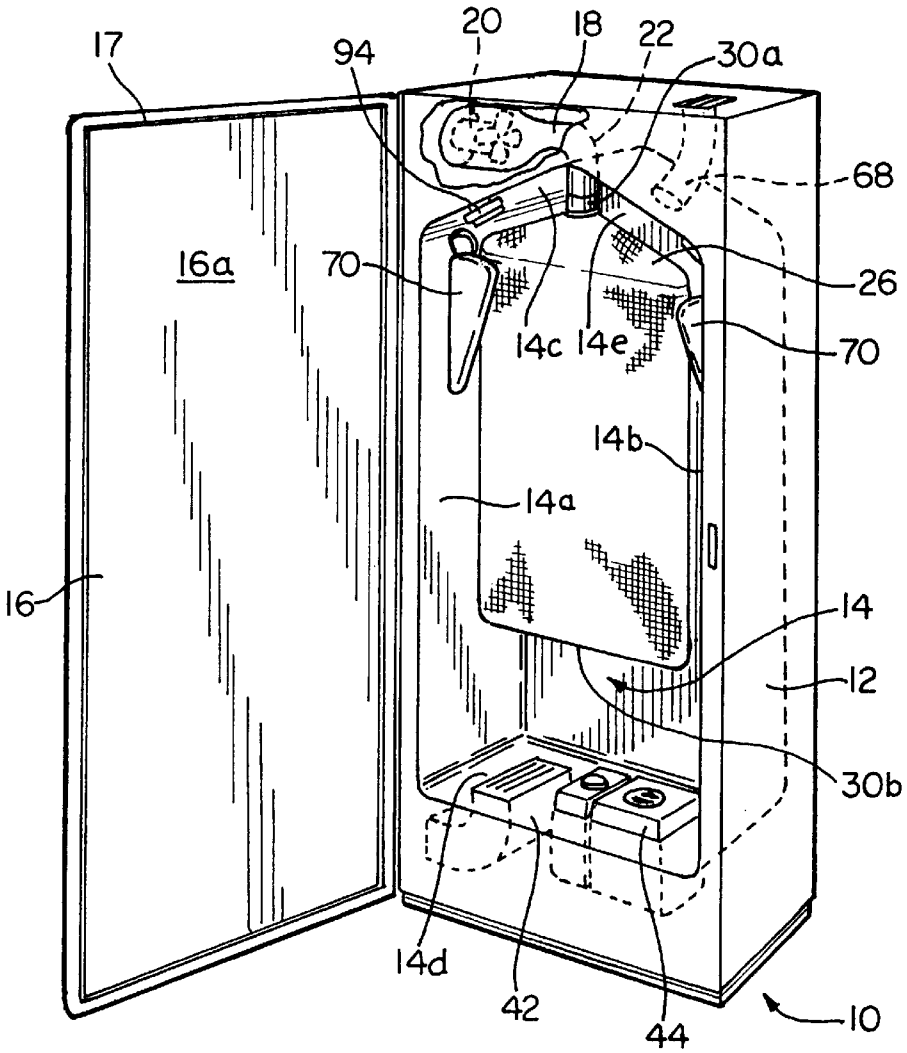
FIG. 1 is a top, front perspective view of the clothes treating cabinet apparatus of the present invention with the door open.

Referring to FIG. 1, there is illustrated a first embodiment of a clothes treating apparatus for steaming, dewrinkling, and deodorizing clothing according to the present invention. The apparatus 10 includes a main housing or cabinet 12. The cabinet 12 forms an interior region 14 having opposite side surfaces 14*a* and 14*b*, a top surface 14*c*, a bottom surface 14*d* and a rear surface 14*e*. A door 16 is hingedly connected to the cabinet 12 for closing the enclosure 14 formed by the cabinet 12. The door 16 includes an inner surface 16*a* wherein when the door 16 is closed, the rear wall 14e of the cabinet 12 and inner surface 16*a* of the door 16 form opposed inner side surfaces of the enclosure. A gasket 17 is provided disposed about the periphery of the door 16 for sealing the interface between the door 16 and cabinet 12.

Figure 2:
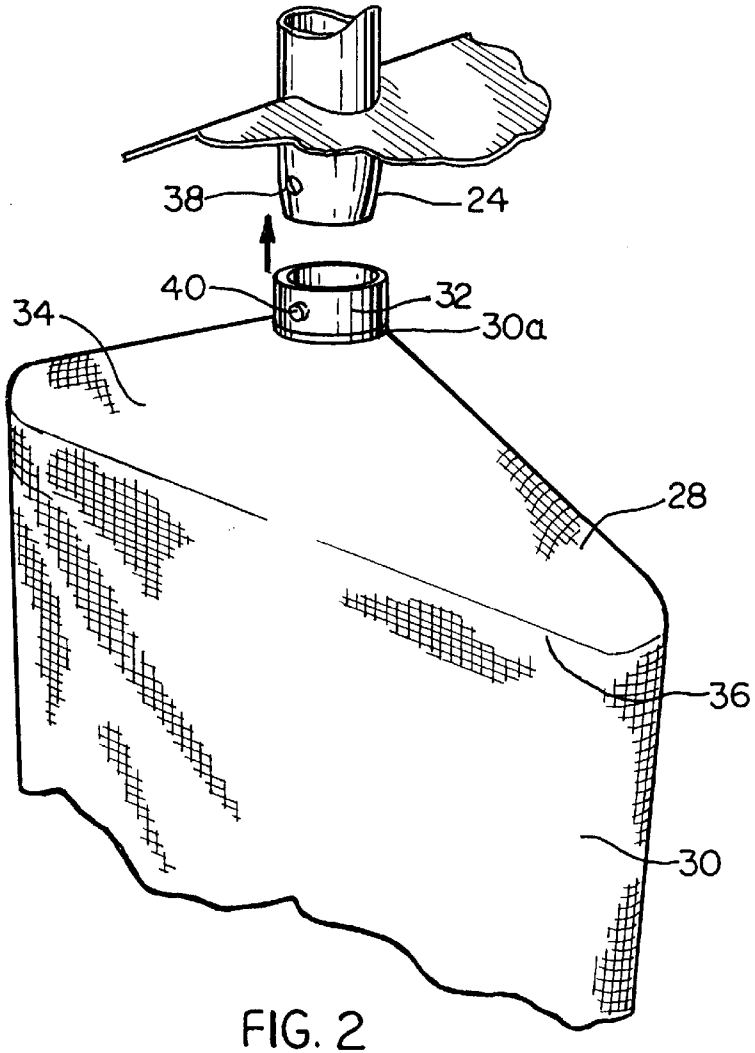
FIG. 2 is a perspective, detailed view of the inflatable hanger assembly shown in FIG. 1.

The cabinet 12 includes an upper housing 18. The upper housing 18 supports a blower assembly 20 which is connected to an air supply duct 22. Alternatively, the blower may be housed in the base with a duct extending to connection 24. The air supply duct 22 has a connection end 24 (FIG. 2) which extends through the top surface 14*c* of the cabinet enclosure 14. When energized, the blower 20 moves air through the duct 22 and out through the connection end 24.

An inflatable hanger assembly 26 including a rigid hanger body 28 and an inflatable bag 30 is supported within the cabinet interior region 14. The inflatable hanger assembly 26 is shown in detail in FIG. 2. The hanger body 28 includes a tubular inlet end 32, a hanger-like hollow body portion 34 and an elongated outlet end 36 which connects to the inflatable bag 30. The hanger body 28 may be contoured to enable easy gripping by a user for facilitating removal from the interior region 14. The tubular inlet end 32 is configured to connect to the connection end 24 such that the blower 20 may blow air into the hanger assembly 26. The means by which the tubular inlet end connects to the connection end can be any quick-connect type system for sealingly connecting two tubular members. For example, the inlet end 32 can be formed as a female end which receives a male type connection end 24 wherein a snap release button 38 on the connection end 24 engages a matching hole 40 provided on the tubular inlet end 32. Alternatively, a bayonet-type mount can be used as can any other suitable connector.

The inflatable bag 30 is removably mounted to the hanger body 28. The inflatable bag 30 has an opening 30*a* at its upper end and an opening 30*b* at its lower end. The opening 30*a* conforms to the shape of the tubular inlet 32. To mount the inflatable bag 30 to the hanger body 28, the hanger body 28 is inserted into the inflatable bag 30 through the opening 30*b* so that the inflatable bag 30 envelopes the hanger body 28. The hanger body 28 is then positioned so that the tubular inlet is inserted through the opening 30*a*. Once the hanger body 28 is properly positioned the upper end of the inflatable bag is sealably mounted to hanger body by any suitable means, such as taping the inflatable bag 30 to the hanger body or providing the opening 30*a* with an elastic collar. The opening 30*b* is then sealed preferably by providing the lower end of the bag with a resealable closure.

The advantage of having a removable bag lies in both maintence and performance of the clothes treating apparatus. The removable mounting permits the bag to be replaced if it is somehow damaged as well as providing ease of access while dressing the bag with a garment. This is especially important for pull over type garments which do not have zippered or buttoned fasteners. Also, different bag sizes and configurations may be needed depending on the size and type of clothing being treated.

Once mounted and sealed to the hanger body 28, the inflatable bag 28 hangs downwardly from the hanger body 28 wherein air supplied to the hanger body 28 inflates the inflatable bag 30. When the inflatable bag 30 is inflated and the door is closed, the side walls of the bag 30 press against rear wall 14*e* and the inner surface 16*a*. In this manner, when the bag is inflated, any shirt-like clothes item placed about the inflatable bag is pressed to remove wrinkles. The pressure applied to the clothes can be designed, by appropriately sizing the blower 20, to optimize dewrinkling clothes. In some cases (dewrinkling delicate clothes), less dewrinkling pressure may be desired. Where less dewrinkling pressure is desired, the inflatable bag 30 may be replaced with a perforated bag which, due to the perforations, applies less pressure to clothes item placed about the inflatable bag. The blower 20 may also be of a variable speed type such that variable dewrinkling pressure may be obtained by varying the blower speed. Alternatively, a fixed speed blower can provide variable speeds by using a flow restricter actuated either mechanically or electrically.

Figure 3:
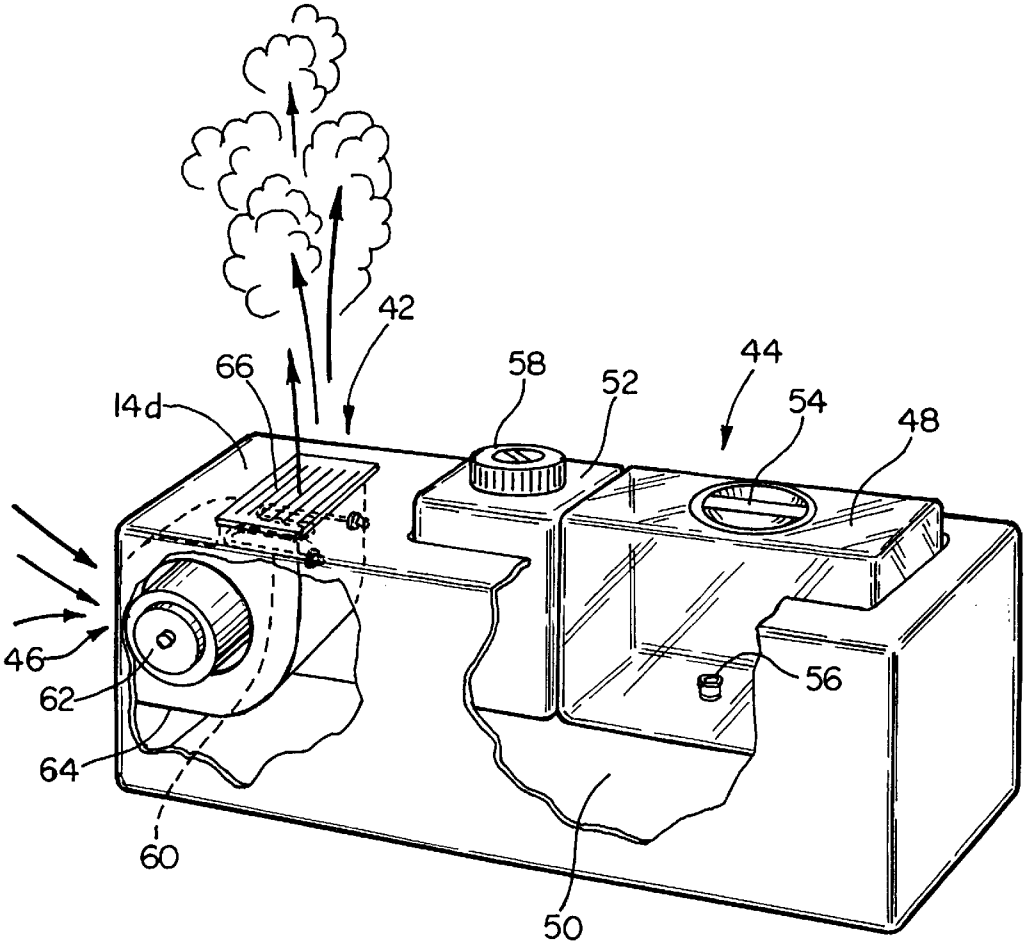
FIG. 3 is a partially cut away top, front and side perspective view of the lower portion of the cabinet of FIG. 1.

Referring to FIGS. 1 and 3, a lower housing 42 is disposed on the bottom portion of the cabinet 12. The lower housing 42 supports a means for moisture generator 44 and a means for generating heated air 46 for delivery into the interior region 14. The moisture generator 44 can be similar to the steam generating means disclosed in U.S. Pat. No. 4,810,854 to Jursich et al, herein incorporated by reference. The lower housing 42 further supports a controller 47 which is controllably connected to the moisture generator 44, the heated air generating means and the blower 20 for controlling their operation.

FIG. 3 illustrates the details of the lower housing 42. The moisture generator 44 comprises a removable reservoir 48, a base 50 and a steam conduit 52. The reservoir includes a handle 54 for facilitating removing and refilling the reservoir 48 with water. The reservoir 48 is supported on the base 50 and a valve 56 is provided in the bottom of the reservoir for allowing water to flow from the reservoir 48 into a pocket (not shown) formed in the base 50. When the reservoir 48 is removed from the base 50, the valve 56 is biased to a closed position so that no water may exit through the valve 56. The base 50 includes a cup shaped boiler (not shown) wherein the steam generated in the cup-shaped boiler is directed up though the steam conduit 52 for delivery into the interior region 14 through a steam dispersing cap 58.

The hot air generating means comprises a heater 60 mounted adjacent a fan 62 disposed in a duct 64. The fan 62 draws air from the exterior of the cabinet 12 through inlet openings (not shown). The fan 62 moves air over the heater 60 through the duct 64 wherein the hot air is directed into the interior region 14 through grill 66. Air is exhausted from the interior region 14 by passing through exhaust duct 68 (FIG. 1) disposed in the upper housing. In this manner, moist air from the interior region 14 is exhausted through the top of the cabinet 12 and may be connected with duct work such that the exhaust air is vented out of the user's home as is conventional in dryer applications.

Figure 4:
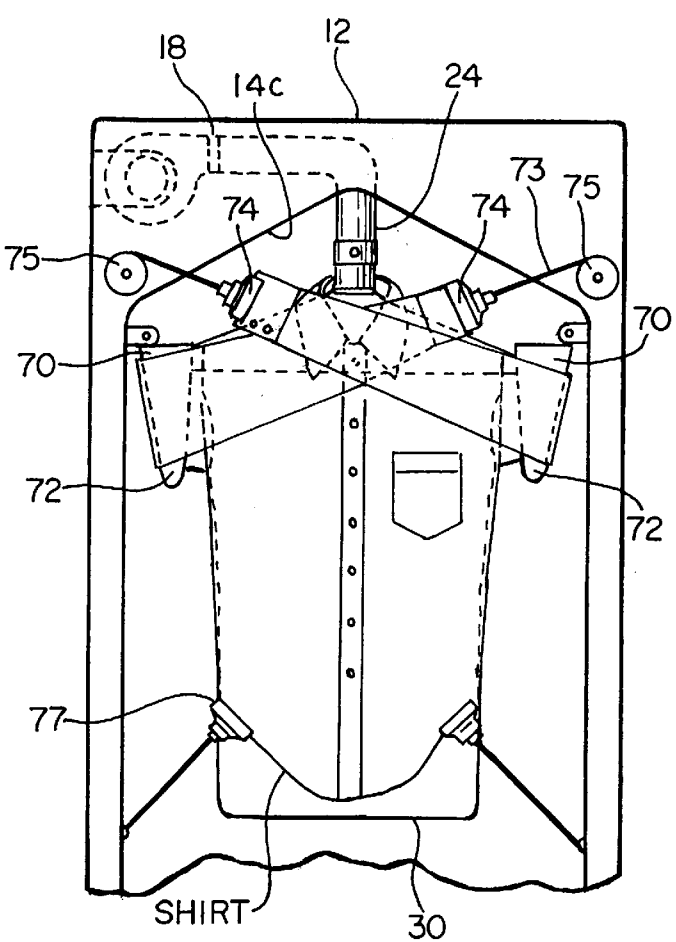
FIG. 4 is a front view of the cabinet of FIG. 1, illustrating the manner in which a shirt-like clothes item may be supported.

Turning now to FIG. 4, details of a beneficial system for supporting clothes within the interior region 14 will be described. The inflatable hanger assembly 26 is designed to support a shirt-like clothes item within the interior region 14 similar to a conventional hanger. Hanging the shirt-like clothes item is facilitated by the removability of the hanger assembly from the cabinet 12. One problem area in a dewrinkling process such as provided in the present invention are the shirt sleeves. To satisfactorily dewrinkle shirt sleeves they must be supported in a manner to minimize undesirable crease lines. It has been found that supporting a shirt-like item on the hanger assembly 26 while leaving the sleeves to hang adjacent the body of the shirt results in unsatisfactory dewrinkling performance.

Accordingly, the present invention includes a shirt sleeve support system. Pivotably supported along both sides of the interior region 14 are weighted shirt sleeve bars 70. Each bar has a tapered edge surface 72 around which a shirt sleeve can be wrapped and stretched toward the top center portion of the interior region 14. The sleeve bars 70 may be hingedly supported as shown or alternatively may be supported by cords attached to the side walls of the interior region 14. Clamps 74 are provided connected to support cords 73 which extend from retractable reels 75 disposed within the upper housing 18. Alternatively, the clamps 74 may be supported by elastic bands connected to the top surface 14c of the interior region 14. Shirt sleeves which are wrapped around the shirt sleeve bars 70 may be tensioned by securing the clamps 74 to the terminal edges of the shirt sleeves such that the shirt sleeves are drawn tightly across the bars 70 in an ideal manner for dewrinkling.

To enhance the dewrinkling performance of the present invention, several further clothes preparation steps may be taken. The shirt-like clothes item, when placed about the hanger assembly, may have one or more of its front buttons buttoned to secure the clothes item in place. Moreover, the bottom of the shirt may be secured by weighted clamps 77. The weighted clamps may be secured to the side wall of the interior region by means of an elastic cord.

Figure 5:
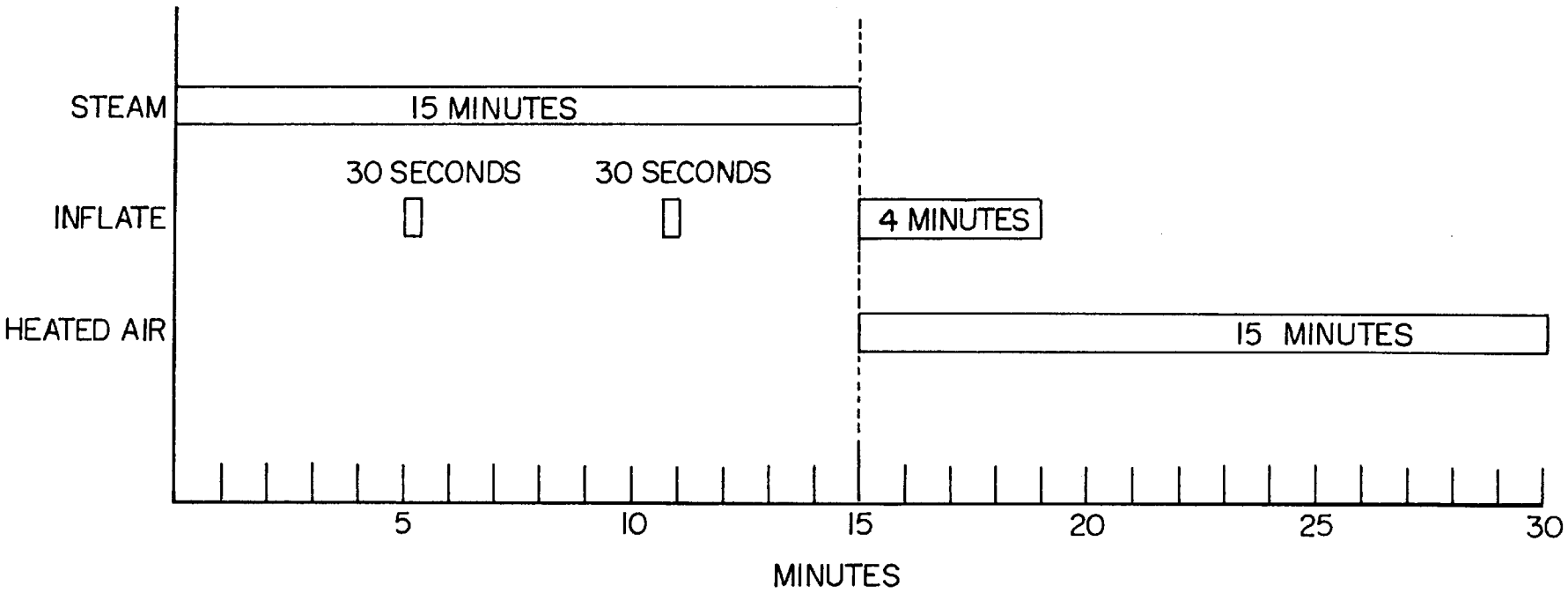
FIG. 5 is a chart illustrating the operation of the present invention.

Once a shirt-like clothes item is correctly supported on the hanger assembly 26, the clothes item is subject to moisture, heat and pressure to freshen and remove wrinkles from the shirt-like clothes item. FIG. 5 illustrates a preferred cycle for refreshing and removing wrinkles from the clothes item. The cycle is approximately 30 minutes in total length. During the first 15 minutes, referred to as the steam period, steam is continuously supplied to adequately dampen the clothes item. At predetermined periodic points, for 30 second periods, the blower 20 is energized to inflate the bag 30. This begins the dewrinkling process and facilitates the absorption by the clothes item of any moisture condensing on the side walls of the interior region 14. Cool air may be recirculated in the cabinet to ensure uniform distribution of moisture on the garment.

At the conclusion of the steam period, the blower 20 is energized to inflate the bag 30 for approximately 4 minutes while the heated air is supplied into the interior region 14. During this time, the clothes are pressed against the interior surfaces 14*e* and 16*a* such that wrinkles are removed and the clothes items are smoothed. Subsequent to this clothes pressing period, hot air is supplied by the hot air generator into the enclosure 14 to thoroughly dry the clothes item.

An advantage of this method of operation is that during the steam period, a layer of moisture is generally evenly distributed on the surfaces 14*e* and 16*a*. Thus, when the clothing is pressed against the surfaces 14*e* and 16*a* a thin layer of moisture is deposited evenly onto the surface of the clothing as the hot air is supplied to the clothing. The thin layer of moisture aids in dewrinkling the clothing and since the moisture layer is evenly distributed, there is no problem with spotting of the clothing. Furthermore, the thin layer of moisture is not sufficient to saturate the clothing, which can have a negative impact on dewrinkling performance in addition to increasing drying time, especially with certain types of material.

It is also contemplated that the clothes treating apparatus can be operated in such a manner as to provide a gentle dry cycle. For a gentle dry cycle, it is assumed that an already cleaned and still wet article of clothing will be mounted to the hanger assembly 26 and exposed to heated air for a period of time depending on the type of fabric being dried. At the end of the initial drying period, the garments are subjected to a steaming period in which the fabric is relaxed to help prevent distortion and wrinkling. Optionally, the bag-hangers may be inflated to remove wrinkles after the steaming period. After the steaming (and pressing) cycle(s), the garment undergoes a short (10 minute) drying period to remove moisture generated by the steam. An advantage of gentle dry with a bag over that of normal steam or drying cabinets is that the friction between the garment and bag may prevent distortion.

Figure 7:
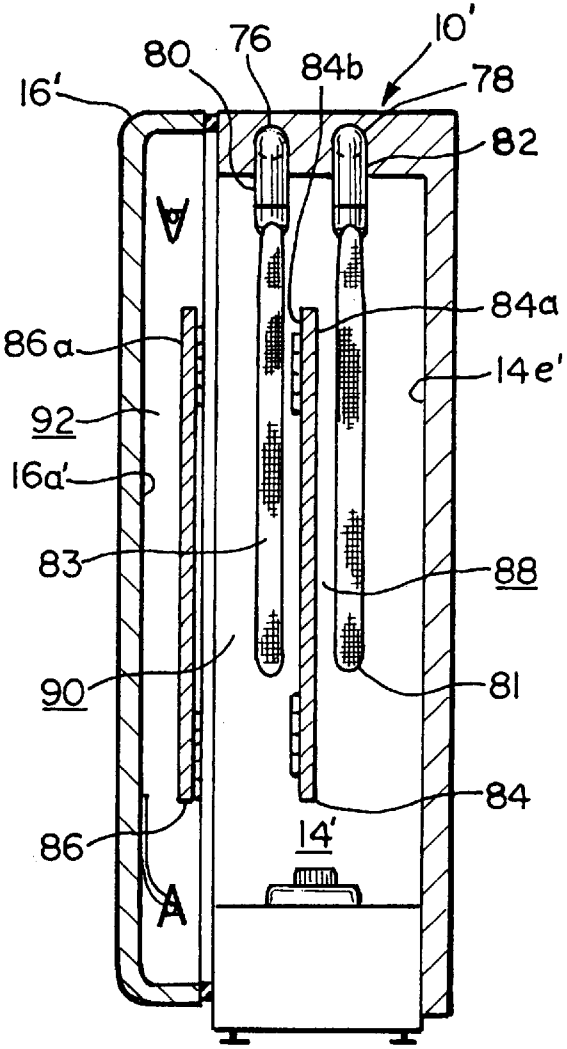
FIG. 7 is a sectional view of the clothes treating cabinet apparatus of FIG. 6.
Figure 6:
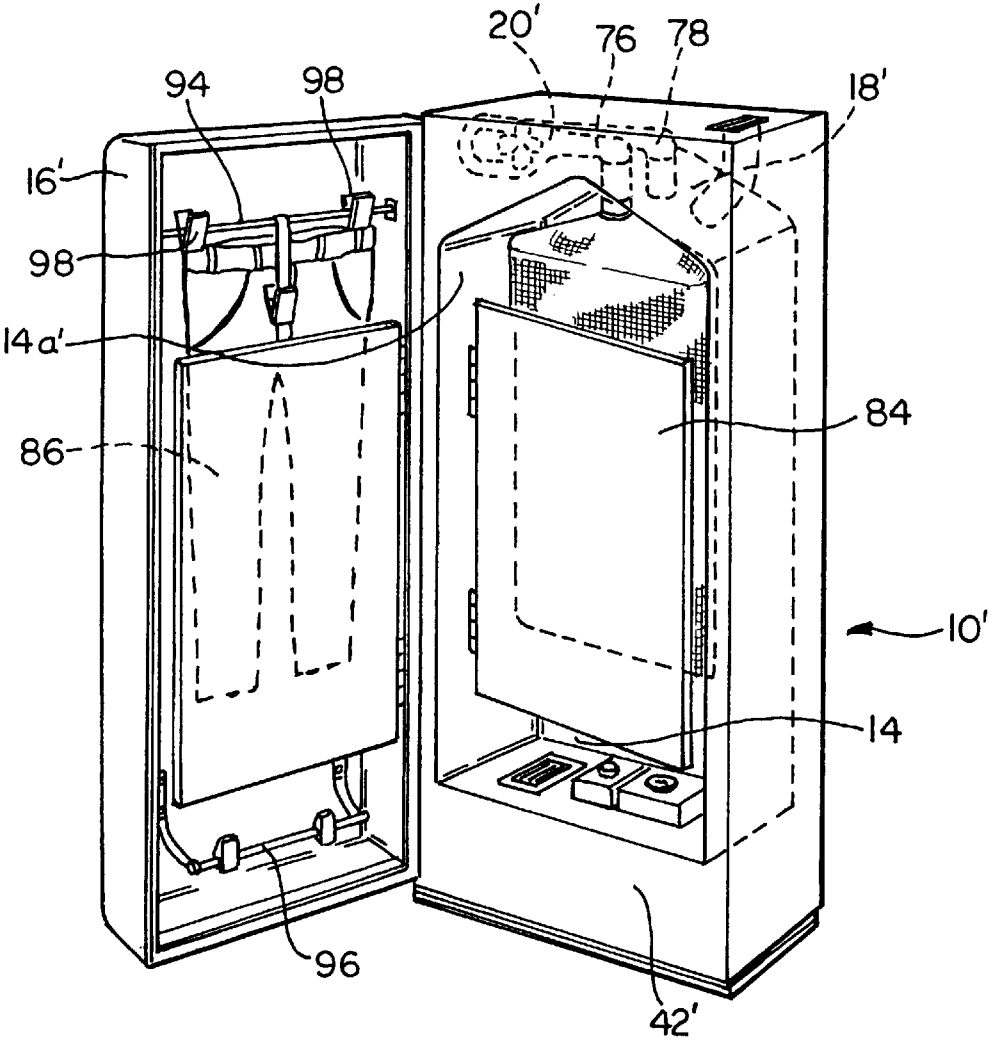
FIG. 6 is a top, front perspective view of a preferred alternative embodiment of the clothes treating cabinet apparatus of the present invention with the door open.

FIGS. 6 and 7 illustrate an alternative, preferred embodiment of the present invention for a clothes treatment apparatus 10' which is designed with the capability of simultaneously pressing more than one clothes item. In this embodiment, the upper housing 18' supports a blower 20' which provides air through a first duct 76 and a second duct 78. Both air supply ducts 76 and 78 have connection ends 80 and 82, respectively. The connection ends are capable of engaging a tubular inlet end of a inflatable hanger assembly in a similar manner as described above. In this manner, two inflatable hanger assemblies, 81 and 83, are supported within the interior region 14'.

A divider wall 84 is hingedly mounted to one of the inner side surfaces 14*a* ' of the interior region 14'. The divider wall can be secured in a closed position within the interior region 14' by a latch (not shown). The divider wall 84 is positioned such that in a closed position, the divider wall 84 is disposed between the two inflatable hanger assemblies. In inner door 86 is also hingedly mounted to the inner side surface 14*a* ' and can be secured in a closed position by a latch (not shown).

When both the divider wall 84 and the inner door 86 are in a closed position, they form compartments 88 and 90 in which the hanger assemblies 81 and 83 hang. When the hanger assemblies are inflated, the clothes item supported on first hanger assembly 81 is pressed against the rear surface 14*e* ' and the opposed side surface 84*a* of the divider wall 84 while the clothes item supported on the second hanger assembly 83 is pressed against the opposed side surfaces 84*b* and 86*a* of the divider wall 84 and the inner door 86, respectively. In this fashion, two shirt like items may be pressed in a single cycle of the apparatus 10'.

To provide further capacity to the clothes treatment apparatus 10'. The door 16' can be provided with a door recess 92 defined by the inner wall 16*a* ' of the door 16'. A support bar 94 and a tension bar 96 can be supported within the door recess 92. Pants-like clothes items can be supported from the bar 94 by use of clips 98 and subjected to the moisture and heat during the apparatus operation. To facilitate dewrinkling, the tension bar 96 can be secured to the pants-like clothes item along the clothes item bottom edge. Alternatively, weighted clamps may be secured to the pants-like clothes items to supply tension during the application of heat and moisture.

A support bar, similar to support bar 94, may also be connected to the top surface 14*c* ' of the interior region 14' such that a pants-like clothes item may be disposed in one or both of the compartments 88 and 90. In this configuration, when the inflatable hanger assemblies 81 and 83 are inflated, the pants-like clothes item is pressed between the inflatable bag and the opposed surfaces. In this manner, the inflatable hanger assemblies 81 and 83 may be used to press either shirt-like clothes items or pants-like clothes items. It can be readily understood that use of the pants bar 94 in combination with an inflatable hanger assembly may be employed likewise in a single hanger assembly apparatus as above described in the first embodiment.

As described above, a perforated inflatable bag may be utilized to limit the pressure applied to a clothes item. Where a perforated bag is used in combination with a non-perforated bag in the multi-hanger bag system disclosed in FIGS. 6 and 7, a flow restricter may be placed within the connection end supporting the perforated hanger bag such that the desired pressure may be established in the non-perforated inflatable bag.

Figure 8:
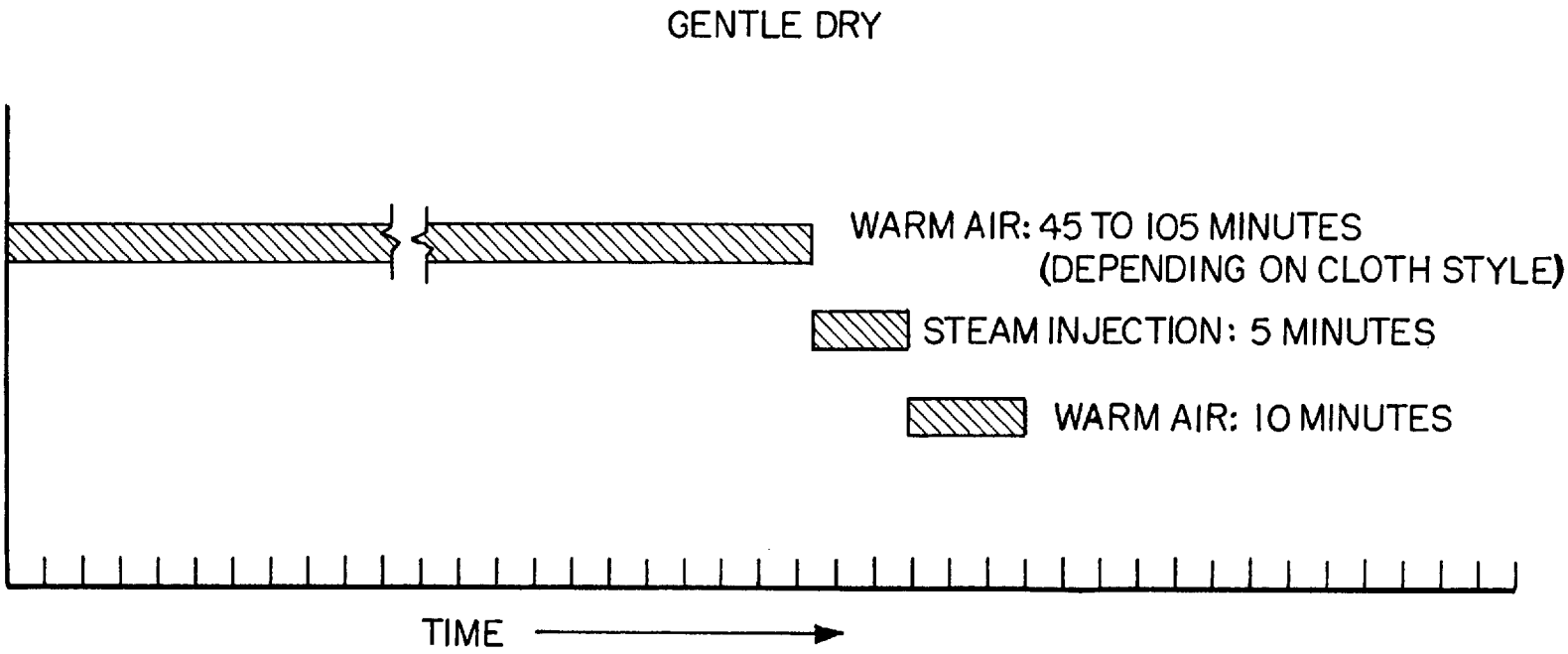
FIG. 8 is a chart illustrating an alternative operation of the present invention.

FIG. 8 illustrates an alternative manner or mode of operating the present invention wherein the cabinet apparatus of the present invention can be used as a gentle dry apparatus for gently drying clothes after hand washing or after a conventional washer cycle. In this mode, fabric items are placed in the cabinet 12—either supported by the inflatable hanger assemblies or hanging from support bars—and dried. The cycle includes an extended warm air dry for between 45 and 180 minutes during which time the heater 60 and fan 62 are energized. Following this period, steam is introduced into the interior region for relaxing and partially dewrinkling the fabric items. Subsequently, warm air is supplied for about 10 minutes for thoroughly drying the clothes items.

It can be seen, therefore, that the present invention provides a unique clothes treatment cabinet which effectively dewrinkles clothes by applying humidity, pressure and heat. Although the present invention has been described with reference to a specific embodiment, those of skill in the Art will recognize that changes may be made thereto without departing from the scope and spirit of the invention as set forth in the appended claims.

We claim:

1. A clothes treating apparatus comprising:

a cabinet defining an interior region for receiving clothes, the interior region having opposed inner side surfaces;

a door movably connected to the cabinet;

a hanger for supporting a clothes item within the interior region, the hanger having an inflatable bag wherein the clothes item can be disposed about the inflatable bag portion; and a blower supported by the cabinet for inflating the inflatable bag to press the clothes item against the opposed inner side surfaces of the interior region.

2. The clothes treating apparatus according to claim 1, and further comprising a moisture generator for introducing moist air into the interior region of the cabinet for humidifying the clothes item disposed therein.

3. The clothes treating apparatus according to claim 1, wherein the door forms one of the opposed surfaces.

4. The clothes treating apparatus according to claim 1, wherein the bag is removably mounted to the hanger.

5. The clothes treating apparatus according to claim 4, wherein the bag has a bottom opening with a resealable closure.

6. The clothes treating apparatus according to claim 5, wherein the bag has an upper opening that is sealed relative to the hanger.

7. The clothes treating apparatus according to claim 1, wherein the clothes item supported within the cabinet includes sleeves, the clothes treating apparatus further comprising:

a pair of sleeve bars supported within the interior region about which the sleeves of a clothes item disposed within the interior region can be wrapped; and means for drawing the sleeves of the clothes item toward opposite sides of the interior region such that the sleeves of the clothes item are drawn across the clothes item.

8. The clothes treating apparatus according to claim 1, wherein the clothes item supported within the cabinet includes sleeves, the clothes treating apparatus further comprising:

a pair of sleeve bars supported within the interior region about which the sleeves of a clothes item disposed within the interior region can be wrapped;

a pair of retractable reels supported adjacent the interior region, the reels having support cords and clamps connected to the support cords wherein the clamps can be secured to the shirt sleeves of the clothes item such that the reels tension the shirt sleeves about the sleeve bars.

9. The clothes treating apparatus according to claim 1, wherein the clothes item supported within the cabinet includes sleeves, the clothes treating apparatus further comprising:

a pair of sleeve bars supported within the interior region about which the sleeves of a clothes item disposed within the interior region can be wrapped; and a pair of elastic bands supported adjacent the interior region, the elastic bands having clamps for connecting to the sleeves of a clothes item such that the elastic bands tension the sleeves about the sleeve bars.

10. The clothes treating apparatus according to claim 1, further comprising:

means for introducing heated air into the interior region for drying the clothes item disposed therein; and control means for providing:

a steam period wherein the means for introducing moist air is operated for introducing moist air and the means for inflating the inflatable bag is intermittently operated such that the inflatable bag is periodically inflated during the steam period, followed by a pressing period wherein the means for inflating the inflatable bag is operated to inflate the inflatable bag, and then a drying period wherein the means for introducing heated air is operated for supplying heated air into the interior region.

11. The clothes treating apparatus according to claim 1, further comprising:

a divider wall supported within the cabinet for seperating the interior region into a plurality of compartments, each compartment having opposed side surfaces, wherein the hanger is associated with one of the compartments such that when the inflatable bag is inflated the cloths item is pressed against the opposed side surfaces of the compartment in which the hanger is positioned.

12. The clothes treating apparatus according to claim 11, further comprising:

a plurality of hangers for supporting clothes items within the cabinet, one hanger being associated with each compartment, each hanger having an inflatable bag portion.

13. The clothes treating apparatus according to claim 12, further wherein the divider wall is hingedly connected to the cabinet and can be rotated between an open and closed position.

14. The clothes treating apparatus according to claim 11, further comprising:

a support bar connectable to the cabinet for hanging a pants-like clothes item within one of the compartments.

15. The clothes treating apparatus according to claim 1, further wherein:

the door has an inner surface forming a door recess compartment, and the clothes treating apparatus further comprises:

an inner door hingedly connected to the cabinet for separating the door recess compartment from the interior region; and a support bar for supporting a clothes item within the door recess compartment wherein moist air and heated air may be supplied into the door recess compartment for treating clothes hanging therein.

16. The clothes treating apparatus according to claim 1, further wherein:

the clothes item supported on the hanger includes a main body and sleeves; and the inflatable bag presses substantially the entire main body of the clothes item against the opposed inner surfaces of the interior region when inflated.

17. The clothes treating apparatus according to claim 1, further wherein:

the inflatable bag moves the clothes item outwardly against the opposed inner surfaces for pressing the clothes item against the opposed inner side surfaces of the interior region.

18. A clothes treating apparatus comprising:

a cabinet for defining an interior region for receiving clothes, the interior region having opposed inner side surfaces;

a door hingedly connected to the cabinet;

a divider wall hingedly supported within the cabinet for separating the interior region into a first compartment and a second compartment, each of the compartments having opposed side surfaces;

a first hanger for supporting a clothes item within the first compartment, the hanger having an inflatable bag portion for pressing the clothes item against the opposed side surfaces of the compartment in which the hanger is located;

a second hanger for supporting a clothes item within the second compartment, the hanger having an inflatable bag portion for pressing the clothes item against the opposed side surfaces of the compartment in which the hanger is located;

a moisture generator supported by the cabinet for introducing moist air into the interior region of the cabinet for humidifying the clothes item disposed therein;

a blower supported by the cabinet for inflatable bag for pressing the clothes item against the opposed inner side surfaces of the interior region; and means for introducing heated air into the interior region for drying the clothes item disposed therein.

19. The clothes treating apparatus according to claim 18 wherein the clothes item supported within the cabinet includes sleeves, the clothes treating apparatus further comprising:

means for tensioning the sleeves of the clothes item within the first and second compartments.

20. The clothes treating apparatus according to claim 18, further comprising:

control means for providing:

a steam period wherein the means for introducing moist air is operated for introducing moist air and the means for inflating the inflatable bag is intermittently operated such that the inflatable bag is periodically inflated during the steam period, followed by a pressing period wherein the means for inflating the inflatable bag is operated to inflate the inflatable bag, and then a drying period wherein the means for introducing heated air is operated for supplying heated air into the interior region.

21. The clothes treating apparatus according to claim 18, further comprising:

a support bar connectable to the cabinet for hanging a pants-like clothes item within one of the compartments.

22. A method of dewrinkling a clothes item having a main body and sleeves fitted onto an inflatable hanger and disposed within an interior region of a cabinet having opposed inner surfaces, the method comprising:

inflating the inflatable hanger; and pressing the main body of the clothes item fitted on the inflatable hanger between the inflatable hanger and the inner surfaces of the interior region by the inflation of the inflatable hanger for dewrinkling the clothes item.

23. The method of dewrinkling a clothes item according to claim 22, further comprising:

delivering moisture into the interior region of the cabinet during a steaming period;

periodically inflating the inflatable hanger for applying pressure to the clothes item during the steaming period; and subsequently inflating the inflatable hanger for a predetermined period during a pressing period such that the clothes item is pressed smooth.

24. The method of dewrinkling a clothes item as claimed in claim 22, further comprising:

delivering heated air into the interior region of the cabinet following the pressing period for drying the clothes item.

25. The method of dewrinkling a clothes item as claimed in claim 22, further comprising:

delivering heated air into the interior region during at least a portion of the pressing period.

26. The method of dewrinkling a clothes item as claimed in claim 22, further comprising:

intermittently delivering warm air into the interior region during the steaming period; and delivering hot air into the interior region following the pressing period.

27. The method of dewrinkling a clothes item as claimed in claim 22, wherein a clothes item having sleeves is fitted about the inflatable hanger and dewrinkling method further comprises:

tensioning the sleeves of the clothes item about a sleeve bar such that the sleeves are held in a flat manner for pressing.

* * * * *